United States Patent [19]

Hornung et al.

[11] Patent Number: 4,502,549

[45] Date of Patent: Mar. 5, 1985

[54] SPRING-COUPLED POWER SCREWDRIVER

[75] Inventors: Friedrich Hornung, Stuttgart; Wolfgang Jundt, Ditzingen; Fritz Schädlich, Leinfelden-Echterdingen; Hans-Joachim Vogt, Stuttgart; Steffen Wünsch, Dettenhausen, all of Fed. Rep. of Germany

[73] Assignee: Robert Bosch GmbH, Stuttgart, Fed. Rep. of Germany

[21] Appl. No.: 466,836

[22] Filed: Feb. 16, 1983

[30] Foreign Application Priority Data

Mar. 25, 1982 [DE] Fed. Rep. of Germany ..... 3210889

[51] Int. Cl.[3] ..... B25B 23/14

[52] U.S. Cl. ..... 173/12; 73/862.34; 81/469; 81/477

[58] Field of Search ..... 173/12; 81/469, 470, 81/477; 73/862.33, 862.34; 324/161, 173

[56] References Cited

U.S. PATENT DOCUMENTS

| | | | |
|---|---|---|---|
| 1,111,848 | 9/1914 | McCoy et al. | 73/862.34 |
| 1,946,100 | 2/1934 | Norton | 73/862.33 |
| 2,228,032 | 1/1941 | MacGregor et al. | 73/862.34 |
| 3,970,151 | 7/1976 | Workman, Jr. | 173/12 |
| 3,982,419 | 9/1976 | Boys | 173/12 |
| 4,328,871 | 5/1982 | Gluskin | 173/12 |
| 4,418,765 | 12/1983 | Mori et al. | 173/12 |

FOREIGN PATENT DOCUMENTS

| | | | |
|---|---|---|---|
| 2731090 | 1/1979 | Fed. Rep. of Germany . | |
| 694778 | 10/1979 | U.S.S.R. | 73/862.34 |

*Primary Examiner*—Frank T. Yost
*Assistant Examiner*—Hien H. Phan
*Attorney, Agent, or Firm*—Frishauf, Holtz, Goodman & Woodward

[57] ABSTRACT

A helical spring couples a drive shaft geared to the motor with the work spindle. With this arrangement hard screwdriving operations can be extended in time so that time is added for the drive motor to come a stop after it is switched off. Transducers are provided for measuring the torque at which motor switch-off occurs, and also the cumulative angle of rotation, the latter for detecting defective screws. No switchdown of the drive speed is necessary before the screw is driven home.

14 Claims, 2 Drawing Figures

SPRING-COUPLED POWER SCREWDRIVER

This invention concerns power screwdrivers of the kind arranged to be switched off when the torque applied to a screw exceeds a predetermined value.

A power screwdriver of that kind is disclosed in German published patent application (OS) No. 27 31 090. This known power screwdriver has a torque measuring device and a coupling by which the drive speed of the screwdriver is reduced shortly before the screw is screwed in tight.

Various electrical or pneumatic drive equipments are known that drive in the screw at high speed until just before the final tightness is reached, when they tighten the screw at slow speed. The known power screwdrivers have the disadvantage that by means of a gear transmission or by change of the supply frequency in the case of alternating current motors, the operating speed is reduced shortly before the termination of the screwing-in process, because otherwise an overdriving of the screw fastening is possible as the result of the fact that the switching off operation requires a certain interval of time. On account of the necessary switching over devices, the known power screwdrivers are expensive and, furthermore, in their operation a relatively long time is spent until the screwing-in operation is complete.

THE INVENTION

It is an object of the present invention to provide a power screwdriver in which highspeed driving can constitute a larger proportion of each operation and in which the switching off operation does not have to begin so soon.

Briefly, a spring is interposed in the drive between the working shaft and the drive shaft. This has the advantage that a screw fastening operation can be carried out without speed switching. The common two-stage system of driving at high speed and then at reduced speed can be entirely dispensed with. The expense of gearing and clutches is greatly reduced. There is also the further advantage that the weight of the screwdriver is reduced so that it is easier to handle.

It is particularly advantageous for the spring to engage at its ends in respective coupling grooves of the drive shaft and the working shaft. In that way, a good force-transmitting connection between the shaft is provided. If the coupling grooves are chamfered in the direction of rotation, there is the advantage that the spring can be made to become disengaged from the groove in case of overload. It is also desirable to provide transducers on the drive shaft and/or the working shaft by which the relative rotary displacement angle can be measured. For measurement of a torque angle, it is advantage to measure the twist angle of the spring by providing one segment of a transducer on the drive shaft and another segment of it on the working shaft. It is also effective to determine the total rotary angle by affixing a transducer on the drive shaft and/or a transducer on the working shaft. Thus with one transducer the total rotary angle can be determined, whereas by obtaining the difference of the two transducer signals, there can be determined the torque which is proportional to the twist of the spring. The spring is advantageously protected by a segment shell, so that contamination of the device by dirt cannot occur. The segment shell advantageously also serves as the segment ring for one transducer. In that way an economical construction of the power screwdriver is obtained that requires few parts. It is also favorable to dispose the transducers spatially close to each other, thus providing a particularly simple construction.

THE DRAWING

The invention is further described by way of two illustrative examples with reference to the annexed drawings, in which:

FIG. 1 shows a first embodiment of a power screwdriver, partly in side elevation, partly in section and with diagrammatic connections, and FIG. 2 similarly shows a second embodiment of power screwdriver, in this case with adjacently located transducers.

DESCRIPTION OF THE ILLUSTRATED EMBODIMENTS

Figure 1:
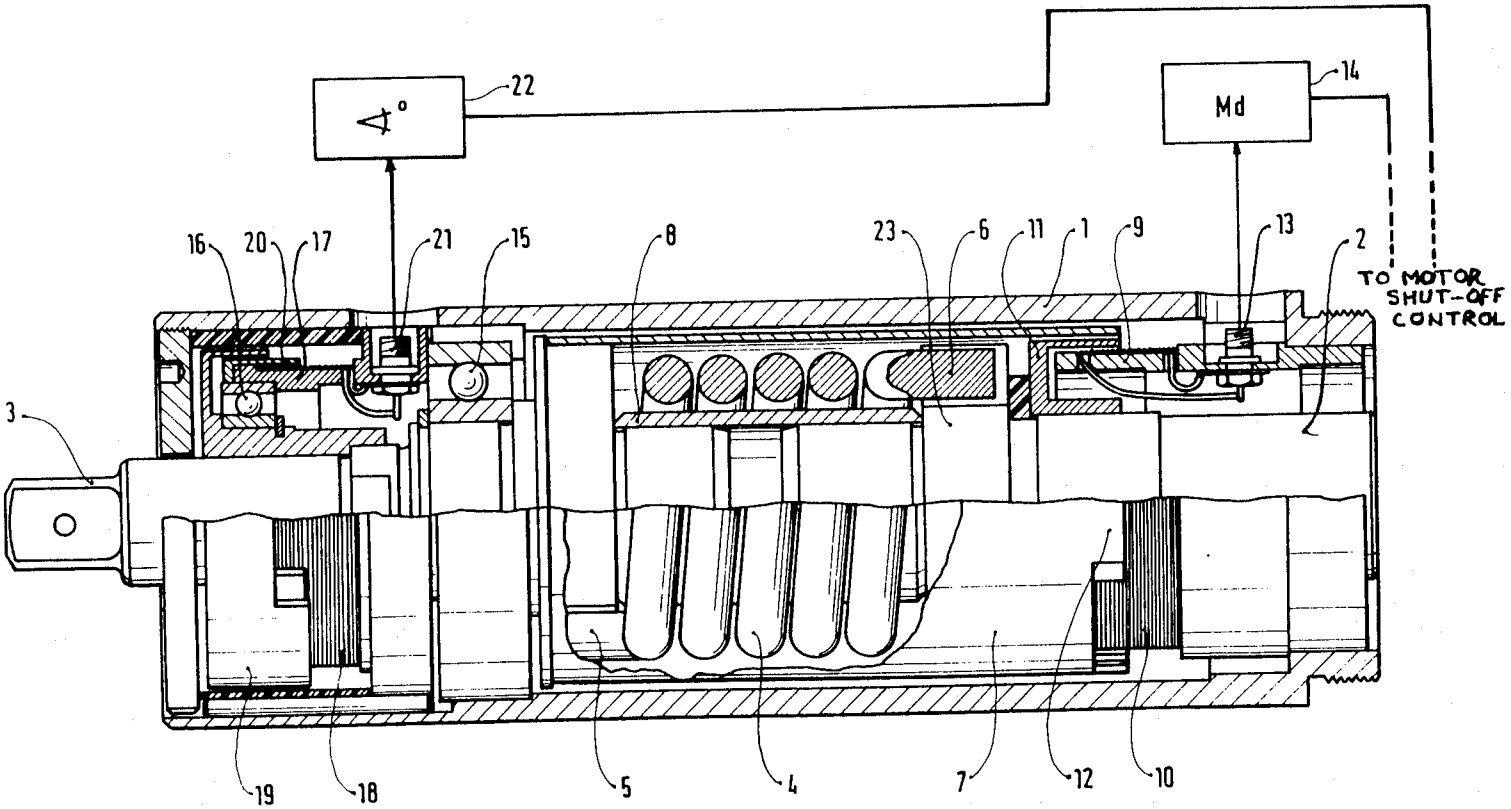

The power screwdriver mechanism shown in FIG. 1 has a casing 1, a drive shaft 2 and a work shaft 3 (sometimes referred to as the spindle). A gear box (not shown) driven by a motor (not shown) is connected to the drive shaft 2. The motor may be an electric motor or an air-pressure motor, for example. The tool (not shown) to be driven is to be mounted firmly on the work shaft 3.

The drive shaft 2 and the work shaft 3 are connected together through a spring 4. The spring 4 is engaged in a groove 5 of the work shaft 3 and in a groove 6 of the drive shaft 2. The grooves 5 and 6 are chamfered in the direction of rotation, so that in case of overload the spring can be driven out of the groove. The groove 5 is provided in a part of the structure of the work shaft 3 presently to be described, and the groove 6 is provided in a thickened portion 23 of the drive shaft 2. The spring 4 is surrounded by a segment shell 7 that is fixed to the work shaft 3. Between the spring 4 and the drive shaft 2 on the one hand, and the work shaft 3, a guiding shell 8 is also provided in order to increase the stability of the screwdriver device and in order to prevent axial pressure on the spring 4. The segment shell 7 is constituted at its upper end 12 as a segment ring, which has two or a larger even number of milled-out gaps which are evenly distributed about the circumference. The segment ring 12 turns with the work shaft 3. A coil body 9 with a coil 10, which annularly surround the drive shaft 2, are provided in fixed position on the casing 1 of the device. Another segment ring 11 is affixed to the drive shaft 2. The segment ring 11 likewise has two or a larger even number of milled-out gaps that are uniformly distributed around the circumference of the segment ring 11. The connection leads for the coil 10 are brought out to a plug connector 13 where the cable of a torque measuring device 14 may be connected.

The spring provides the possibility of obtaining a measurement signal for the torque in a simple way. Since the twist angle of the spring 4 is proportional to the momentarily transmitted torque, the torque is readily determined when the twist angle is known. This is determined by the torque transducer, which consists essentially of the coil 10 on the coil form 9, together with the two segment rings 11 and 12 which are coaxially aligned with respect to each other, while the coil 10 is mounted fixedly on the casing, the two segment rings 11 and 12 being rotatable with respect to each other. The segment rings 11 and 12 are preferably of aluminum. The torque signal is generated by impedance changes of the coil. The impedance change of the coil is produced by a relative rotation of the two segment rings 11 and 12. It is thus possible in a simple way to obtain a torque signal.

The work shaft 3 is preferably mounted in an annular ball bearing 15. If a rotary angle measurement is desired, for example to measure how far the screw has been driven, another transducer should be provided on the work shaft 3 which is constituted essentially similar to the torque transducer. A coil 18 is provided on a coil form 17 affixed to the casing, thus encircling the work shaft. A segment ring 20 is connected to the coil form in fixed position. The segment ring 20 has three milled slots or cut-outs that are uniformly distributed around its circumference. Another segment ring 19 is affixed to the work shaft. The segment ring 19 likewise has three slots or cut-outs that are uniformly distributed about its circumference. Another bearing 16 provides a secure mounting bearing for the segment rings 19 and 20 with respect to each other. A connection bushing 21 is provided for the terminals of the coil 18 for furnishing an angle signal to an external evaluation circuit 22. The signal magnitude is generated by the angle transducer, again, by impedance changes of the coil 18. The change of impedance is produced, again, by relative rotation of the segment rings 19 and 20 which are preferably constituted as aluminum cylinders. Since the segment ring 20 is fixedly mounted, a signal proportional to angle is produced. The angle signal supplies, as an electrical signal voltage, for example, a triangular voltage of which three periods are produced for one revolution of the work shaft 3.

The torque measurement can also be provided when both transducers are constituted as angle measurers. This means, for example, that the segment ring 11 would be fixedly connected to the coil form 9. Then the difference of the ouput signals of the two angle transducers would be the torque. Although such an arrangement brings certain mechanical simplifications, the evaluation is nevertheless more difficult, because measurement inaccuracies increase with increasing angle value.

The spring 4, which is designed with regard for its twist angle under the maximum torque to be transmitted, has the function of specially extending in time the screwdriving operation in "hard" screwdriving. Such hard screwdriving occurs, for example, if two unyielding metallic bodies are connected with each other. By the spring effect, a "soft" screwdriving is produced out of every "hard" screwdriving operation, so that enough time remains for the operation of switching off the motor. As soon as a prescribed twist and thereby a certain torque is reached, the motor connected to the drive shaft 2 is switched off. Since this switching off does not take place immediately because of the momentum or inertia of the moving masses and the switching delays, the delay is accommodated by a further twisting of the spring 4. It is thereby possible to maintain the same speed of the screwdriver without switching operations from the beginning of screwing in until final tightening. The signal of the angle transducer equipped with the coil 18 serves mainly as a check for recognizing defective screws which have already reached the yield point before reaching the prescribed torque. In such cases an excessive angle shows up.

Figure 2:
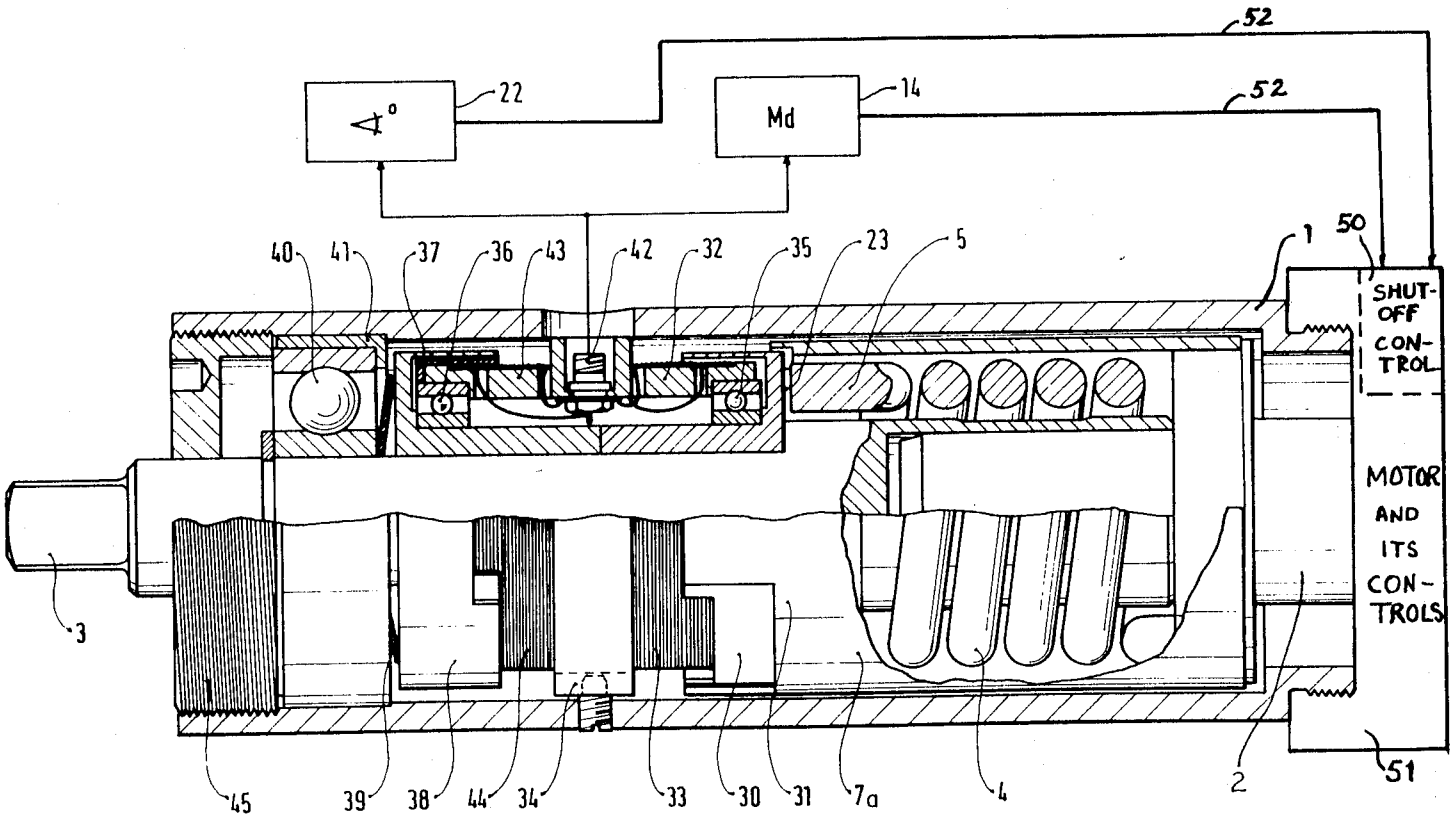

Another screwdriver equipment is shown in FIG. 2. The drive shaft, which is connected to a motor that is not shown, is again designated 2. One end of the spring 4 is again held in a groove of the drive shaft 2. The other end of the spring 4 is held in the groove 5 of the thickening 23 of the work shaft 3. In this embodiment an interior guiding shell is not provided, but instead the work shaft 3 has its end constituted as a blind bore into which the free end of the drive shaft 2 projects. The segment shell *7a* is now connected by a force-fit to the drive shaft 2. A coil holder 34 that is fixedly connected to the casing 1 of the power screwdriver carries on one side the coil 23 and on the other the coil 44, both of which surround the work shaft 3. The segment rings 30 and 31 belong to the coil 33. The segment ring 31 is the upper end of the segment shell *7a*, which again has two or another even number of slots. The segment shell 30 on its part is connected to the work shaft 3. Two connection wires lead from the part of the coil support 34 constituted as the coil form 32 over to a connection 42, where a signal proportional to torque is provided for the torque measuring device 14. In addition, a part of the coil support 34 is constituted as the coil form 43 on which a coil 44 is disposed axially with respect to the work shaft 3. The connections of the coil 44 again go to the connector 42. The segment rings 38 and 37 are provided for cooperation with the coil 44, the segment ring 37 being fixedly connected with the coil support 34. The segment ring 38 is rotatable and is connected to the work shaft 3. The entire transducer arrangement is mounted in bearings 35 and 36. The movably constructed segment ring 38 affixed to the work shaft 3 is pressed against the transducer system by means of a spring disc (cup spring) 39. An annular ball bearing 40 guided in a shell 41 serves for mounting the work shaft 3. The casing is closed off by a threaded ring 45 at its work shaft end.

The embodiment shown in FIG. 2 fulfills the same function as the embodiment of FIG. 1. Impedance changes of the coil 33 resulting from the movement of the segment ring 31 by the drive shaft 2 and of the segment ring 30 by the work shaft 3 serve to indicate the torque. The cumulative angle of rotation can be measured by the coil 44 and the segment rings 37 and 38. The assembly of this device is made simple, however, because the transducers are mounted on a common supporting holder 34 and thus can be set in place together. By this arrangement, the connections can be brought out at a single place in the casing. It is also possible to preassemble the entire transducer apparatus before building it into the casing 1.

FIG. 2 symbolically shows the application of signals from the measuring circuits 14 and 22 to the shut-off portion 50 provided for the motor which is, together with its controls, symbolized by the block 51. When a predetermined value of torque is exceeded, the measurement circuit block 14 responds by providing a signal over the line 52 for shutting off the power to the motor and, likewise, when a predetermined total angle value, which is indicative of a failed screw or screw thread, is detected in the angle measurement circuit 22, a signal is provided over the line 53 for shutting off the motor.

Although the invention has been described with reference to two illustrative embodiments, it will be understood that further variations and modifications are possible within the inventive concept.

We claim:

1. Power screwdriver unit having an automatic-stop control and including a motor and a work shaft for mounting a screwdriving tool thereon, said work shaft being coupled to said motor, said power screwdriver unit further comprising:

a drive shaft (2) connected to said motor for being rotated thereby;

a torsion spring (4) interposed between said drive shaft (2) and said work shaft (3) for coupling said shafts to each other;

a segment shell (7,7*a*) disposed exteriorly of said torsion spring (4) for protection thereof;

means (14) responsive to the torque applied to said work shaft for shutting off said motor when said torque exceeds a predetermined torque value, said torque responsive means including a device for measuring the angle of twist between said drive shaft (2) and said work shaft (3), said device comprising at least one inductive transducer (10,18,33,44);

said segment shell (7,7*a*) being constituted at least at one end so as to provide a segment ring (12,31) for said inductive transducer (10,33);

said spring being of such construction that it can be further deformed in torsion after said torque has exceeded said predetermined torque value for an interval sufficient to allow said motor to come to a stop after being shut off while operating at a normal driving speed.

2. Power screwdriver unit according to claim 1, in which said spring (4) is a helical spring which at one end thereof engages in a coupling groove (5) provided on a structure forming part of said drive shaft (2) and at its other end engages in a coupling groove (6) provided on a structure forming part of said work shaft (3).

3. Power screwdriver unit according to claim 2, wherein said coupling grooves (5,6) are chamfered on one side so that in case of overload, at least one of said spring ends will become uncoupled.

4. Power screwdriver unit according to claim 1, in which an inductive transducer is provided for measuring total rotation angle of at least one of said shafts (2,3).

5. Power screwdriver unit according to claim 1, in which said at least one transducer includes a first segment ring (12,31) mounted so as to turn with said work shaft (3) and a second segment ring (11,30) mounted so as to turn with said drive shaft (2).

6. Power screwdriver unit according to claim 1, in which there are a plurality of said transducers, including a first inductive transducer (10) in the neighborhood of said drive shaft (2) and a second inductive transducer (18) in the neighborhood of said work shaft (3).

7. Power screwdriver unit according to claim 1, in which said segment shell (7,7*a*) is rigidly affixed to one of said shafts (3,2).

8. Power screwdriver unit according to claim 1, in which an additional inductive transducer is provided for measuring total rotation angle of at least one of said shafts (2,3).

9. Power screwdriver according to claim 1, in which said segment ring (12,31) of said transducer is mounted so as to turn with said work shaft (3) and a second segment ring (11,30) is provided for said transducer and is mounted so as to turn with said drive shaft (2).

10. Power screwdriver unit having an automatic-stop control and including a motor and a work shaft for mounting a screwdriving tool thereon, said work shaft being coupled to said motor, said power screwdriver unit further comprising:

a drive shaft (2) connected to said motor for being rotated thereby;

a torsion spring (4) interposed between said drive shaft (2) and said work shaft (3) for coupling said shafts to each other, and means (14) responsive to the torque applied to said work shaft for shutting off said motor when said torque exceeds a predetermined torque value, said torque responsive means (14) including a device for measuring the angle of twist between said drive shaft (2) and said work shaft (3), said device comprising a plurality of inductive transducers (10,18,33,44);

said inductive transducers including a first inductive transducer (33) constructed for responsiveness to rotation of said drive shaft (2) and a second inductive transducer (44) constructed for responsiveness to rotation of said work shaft (3), said transducers (33,44) being disposed spatially close to each other;

said spring (4) being protected by a cylindrical shell (7,7*a*) fixed in position with respect to one of said shafts (2,3) and having one end thereof constituted to provide a segment ring constituting a part of one of said transducers (33,44);

said spring being of such construction that it can be further deformed in torsion after said torque has exceeded said predetermined torque value for an interval sufficient to allow said motor to come to a stop after being shut off while operating at a normal driving speed.

11. Power screwdriver unit according to claim 10, in which said transducers (33,44) are disposed spatially close to each other, and in which said spring (4) is protected by a cylindrical shell (7,7*a*) fixed in position with respect to one of said shafts (2,3) and having one end thereof constituted to provide a segment ring constituting a part of one of said transducers (33,44).

12. Power screwdriver unit having an automatic-stop control and including a motor and a work shaft for mounting a screwdriving tool thereon, said work shaft being coupled to said motor, said power screwdriver unit further comprising:

a drive shaft (2) connected to said motor for being rotated thereby;

a torsion spring (4) interposed between said drive shaft (2) and said work shaft (3) for coupling said shafts to each other, and means (14) responsive to the torque applied to said work shaft for shutting off said motor when said torque exceeds a predetermined torque value, said torque-responsive means including a device for measuring the angle of twist between said drive shaft (2) and said work shaft (3), said device comprising at least one inductive transducer (10,18,33,44), said torsion spring being a helical spring which at one end thereof engages in a coupling groove (5) provided on a structure forming part of said drive shaft (2) and at its other end engages in a coupling groove (6) provided on a structure forming part of said work shaft (3), and being protected by a segment shell (7,7*a*), said segment shell being constituted at least at one end so as to provide a segment ring for (12,31) for said at least one inductive transducer (10,33), said spring being of such construction that it can be further deformed in torsion after said torque has exceeded said predetermined torque value for an interval sufficient to allow said motor to come to a stop after being shut off while operating at a normal driving speed.

13. Power screwdriver unit according to claim 12, in which said segment shell (7,7*a*) is rigidly affixed to one of said shaft (3,2).

14. Power screwdriver according to claim 12, in which there are a plurality of said inductive transducers, including a first inductive transducer (10) in the neighborhood of said drive shaft (2) and a second inductive transducer (18) in the neighborhood of said work shaft (3).

* * * * *